US011466512B2

(12) United States Patent
Morris

(10) Patent No.: US 11,466,512 B2
(45) Date of Patent: Oct. 11, 2022

(54) MODULAR SAFETY GATE

(71) Applicant: Beth Morris, Louisville, TN (US)

(72) Inventor: Beth Morris, Louisville, TN (US)

( * ) Notice: Subject to any disclaimer, the term of this patent is extended or adjusted under 35 U.S.C. 154(b) by 0 days.

(21) Appl. No.: 17/007,882

(22) Filed: Aug. 31, 2020

(65) Prior Publication Data

US 2022/0065032 A1 Mar. 3, 2022

(51) Int. Cl.
*E06B 9/04* (2006.01)
*E05B 65/00* (2006.01)
*E06B 9/00* (2006.01)

(52) U.S. Cl.
CPC ..... *E06B 9/04* (2013.01); *E05B 65/0007* (2013.01); *E05B 65/0014* (2013.01); *E06B 2009/002* (2013.01)

(58) Field of Classification Search
CPC ..... E06B 9/04; E06B 9/02; E06B 2009/002; E05B 65/0007; E05B 65/0014
See application file for complete search history.

(56) References Cited

U.S. PATENT DOCUMENTS 4,465,262 A * 8/1984 Itri ..... E01F 13/02 160/374
4,624,072 A * 11/1986 Zilkha ..... E06B 9/02 49/50
5,483,779 A * 1/1996 Crawford ..... G09F 15/00 135/151
5,575,113 A * 11/1996 Huang ..... E06B 9/02 160/372
5,704,164 A * 1/1998 Huang ..... E06B 9/02 160/372
6,178,693 B1 * 1/2001 Hunt ..... A01K 1/0017 160/222
6,427,396 B1 * 8/2002 Harrison ..... E06B 9/02 52/202
8,196,348 B2 * 6/2012 Flannery ..... E06B 9/04 49/55
8,528,257 B2 * 9/2013 Kobayashi ..... A01K 1/035 49/463
9,689,197 B1 * 6/2017 Flannery ..... E05B 17/2069
10,934,769 B2 * 3/2021 Flannery ..... E06B 11/02
11,035,173 B1 * 6/2021 Flannery ..... E05D 7/04
11,162,300 B1 * 11/2021 Flannery ..... E05C 3/167
2007/0022666 A1 * 2/2007 Andersen ..... E05B 47/026 49/394
2008/0185566 A1 * 8/2008 Flannery ..... E06B 9/06 256/73
2008/0307708 A1 * 12/2008 Quan ..... E06B 9/02 49/55
2009/0158665 A1 * 6/2009 Wu ..... E06B 9/02 49/55
2012/0255234 A1 * 10/2012 Wang ..... E05C 19/16 49/395
2015/0259964 A1 * 9/2015 Linehan ..... E05C 1/10 49/272

(Continued)

*Primary Examiner* — Justin B Rephann

(57) ABSTRACT

A safety gate assembly comprised of the modular and interchangeable components with non-marring surfaces, offering incremental horizontal and vertical adjustability to securely fit within a doorway or other space and without requiring permanent attachment to a doorframe or walls, as well as offering the capability for a stand-alone enclosure with the same features.

18 Claims, 8 Drawing Sheets

(56) References Cited

U.S. PATENT DOCUMENTS

| | | | | |
|---|---|---|---|---|
| 2015/0330142 | A1* | 11/2015 | Pilgrim | E05D 3/02 49/465 |
| 2017/0350165 | A1* | 12/2017 | Schort | E05B 65/0014 |
| 2019/0003250 | A1* | 1/2019 | Flannery | E06B 9/06 |
| 2019/0234139 | A1* | 8/2019 | Flannery | E06B 11/022 |
| 2021/0301589 | A1* | 9/2021 | Miller | E06B 9/0669 |

* cited by examiner

MODULAR SAFETY GATE

This is a Non-Provisional Patent Applications filed for the invention by Beth Morris of 4260 Gravelly Hills Road, Louisville, Tenn. 37777, for new and useful "Modular Safety Gate."

FIELD OF THE INVENTION

The invention relates to a modular gate; and more particularly to a modular gate for installation in existing buildings to restrict movements of children and pets, having advantages for installation in various locations and easier opening and locking features.

BACKGROUND OF THE INVENTION

Pet owners and parents of small children currently use a wide variety of safety gates to keep their pets and small children restricted from certain areas. Safety gates provide an array of essential benefits including safety, training, protection, etc.

Aftermarket child safety gates for installation into existing homes and other buildings have been commercially available for many years. Some are freestanding and simply positioned on the floor in front of an area, such as a doorway or a section within a room, without any attachment to walls to keep young children and pets from navigating away from their confined space. Others are braced via tension bars to opposing doorway walls to prevent entrance. Still others, especially for use at the top of stairways, are permanently fastened to the walls to prevent a child or pet from falling against the gate and dislodging it from its position, possibly causing the child or pet to fall down the stairs and incur injuries.

Freestanding gates are sometimes used to block passage through large openings for which other gates would not be suitable. The disadvantage to freestanding gates is their ability to be toppled over or moved and not contain the child or pet within the desired area. However, these gates are easy to place into position and will not mar wall surfaces as other types of gates will.

Tension gates are used where opposing walls or other structures are available to position a tension bar, whether via use of a compression spring or screw mechanism. Though tension gates can withstand some force before giving way, when they do give way the supporting walls are usually marred or damaged. These gates may also be restricted to fairly narrow spaces. Some manufactures do provide expansion side gates for additional coverage. Tension gates' ease of positioning is more demanding that freestanding gates since tension gates require some strength and dexterity to position.

Gates that must be permanently fastened to the walls, such as screwed or bolted gates, are sturdy when force is applied to the gate structure by a child or pet. However, when the gate is no longer required and/or removed, the areas on the walls where the gate was attached will need to be repaired for esthetic reasons. Positioning of this type of gate demands the knowhow and ability to screw or bolt the gate to the wall. However, it is realized that this option is mandatory for use at the top of staircases for safety reasons.

Currently available safety gates require portions of these gates to lay across the bottom of the gate, above floor level, creating a tripping hazard. Also, currently available safety gates do not allow for infinite adjustability in width and height. Therefore, increasing flexibility of size is desirable.

Also, minimizing the damage caused to the existing building while installing and using a safety gate is desirable. Also, it is desirable to eliminate the need for bottom components to lay across the ground above-floor-level. The instant invention improves upon current art with respect to all of these issues.

SUMMARY OF THE INVENTION

The present invention provides an improved modular child/pet safety Gate. More particularly the present invention provides a modular Gate for installation in existing buildings to restrict movements of children and pets, having advantages for installation in various locations and easier opening and locking features.

One aspect of the present invention is to provide for excellent stability without marring existing walls.

Another aspect of the present invention is to provide horizontal and vertical adjustability in measured increments to provide easy installation into any existing building.

One primary advantage of the present invention is that when the gate door is opened no portion of the Gate Body spans from one side of the door to the other. In other words, unlike safety gates most currently available, the gate provided herein does not require a portion of the gate to connect the two parts of the Gate Body while the gate door is open. This means that the instant invention does not have the tripping hazard created by most currently available safety gates.

The instant invention provides redundant locking mechanisms for securing the gate door.

The instant invention provides for the use of a unidirectional single or double gate door or a bi-directional single or double gate door in conjunction with other components of the gate assembly in a modular fashion.

The instant invention allows for configuration of modular interchangeable components to provide a unique and distinct containment area with the capability of height adjustment and without the need for walls or doorways. The components of said Gate Body can be independently installed in various configurations, allowing the user to customize the size and shape of individual safety gates to function in numerous doorways, halls, stairs, and other spaces, without requiring permanent attachment to a doorframe or walls, as well as offering the capability for a stand-alone enclosure with the same features.

One embodiment of the gate assembly consists of: a Gate Body; horizontally and vertically adjustable side sections; a horizontally and vertically adjustable gate door; adjustable expansion section(s); various redundant locking mechanisms; side arms for attachment to walls; and feet to maintain clearance between the floor and the bottom of the gate.

For purposes of this specification the capitalized term "Gate Body" is used to identify the overall invention, including any components, when put together to form a complete and functional barrier. Whereas, the term "gate" is used to identify that part of a Gate Body that swings on a hinge, or other means of swinging, in relation to the other parts of the Gate Body.

An aspect of the present invention is small modular units, comprised of short pieces of horizontal top rail and bottom rail, connected by one or more vertical spindles. The vertical spindles are nested allowing the spindles to telescope and retract along the vertical axis.

Gate Body

The Gate Body is comprised of materials such as, but not limited to, metal, wood, hard plastics including Lucite, acrylics, carbon fibers, fiberglass, polycarbonate, acetal plastics, composites, thermoplastic and thermoset resins, or other materials, and even combinations of materials, all being strong and durable for use around young children and pets. The materials should offer a structurally sound Gate Body without being too heavy for an adult, young or old, of average stature and physical ability to manipulate. Two adjustable side sections and one or two swinging gate doors, comprise the basic Gate Body, which is adjustable both horizontally and vertically, as well as any optional expansion sections to complete the Gate Body. Each of these components include nested spindles or vertically-linked spindles. For nested spindles, a minimum vertical overlap of two nested spindles should be of sufficient length, for example two inches as a minimum, to keep the spindles from unexpectedly separating if fallen against or pulled/pushed by a child or pet. For vertically-linked spindles, all open ends of the two or more spindle members can be threaded to accept swivel connectors to join the sequence of spindles to one another. All of these components can be constructed in varying widths and heights, of various geometric designs and materials, and with varying spacing between vertical members, with a suggested minimum of two inches, to accommodate desired needs and esthetics.

Some or all of the modular components may include optional additional horizontal rails to increase stability of the component and overall Gate Body.

Gate Body-Adjustable Side Sections

There are two adjustable side sections immediately positioned one on each side of the adjustable gate door, unless expansion units are utilized. These adjustable side sections contain side arms, one at each of the four corners or, alternatively, two at the top corners with two elongated pedestals attached at the bottom corners.

In the preferred embodiment one set of nested spindles, an upper and lower, are attached to their respective upper and lower rails and are incrementally fastened to one another. Said spindles also include spring loaded devices, such as spring plungers, to allow for predetermined vertical adjustments. Spindles are attached to their respective rails to secure in place. One spindle at the non-opening side of the gate door allows the gate door to easily rotate around the nested spindle for opening.

The upper nested spindle members are attached to the side section's top rail, which is match-boxed or horizontally-nested sliding units, with or without tracks or glides, integrated with the top rail to allow horizontal adjustment. The bottom nested spindle members are attached in their respective positions on the bottom rail, similarly to the upper spindle members, to allow horizontal adjustment. In the preferred embodiment the side section's nested outer vertical frame includes spring loaded devices, such as spring plungers, or other appropriate fasteners to keep the entire side section at its user-adjusted height while accommodating vertical movement when temporarily disengaged.

In the preferred embodiment the spindles are all approximately identical in size. However, alternate embodiments may include hinge spindles, locking spindles, or side section spindles that are larger or smaller in diameter than the remaining spindles.

A short foot is attached to the underside of the side section's outer vertical frame to provide sufficient space for the gate door to swing open without scraping the floor or surface below, but not allowing too much vertical space for small objects to be pushed or rolled underneath by a child or pet, especially hands, feet and paws. These short side section feet may also add grip to the floor or surface below pending the materials from which the feet are composed, such as but not limited to rubber or thermoplastic elastomers.

The outer corners of the side sections' horizontal rails are constructed to permit attachment of modular interchangeable side arms and/or pedestals.

The spindles are comprised of upper and lower nested members, in sets of one or more, where each nested set is independent of its nested mate except where select sets, or as otherwise desired, are connected via spring loaded devices, such as spring plungers, or other appropriate connectors to facilitate vertical adjustment of the side sections and to hold in place once adjusted. Alternatively, the spindles can be absent of these fasteners if those within the side sections' frames can solely maintain the desired height of the gate. A minimum vertical overlap of all upper and lower spindles and vertical frames is of sufficient length to offer strength and to keep the spindles and frames from unexpectedly separating if contacted or pulled or pushed by a child or pet.

In the preferred embodiment a nested spindle is used in lieu of hinges for gate door opening. The modular unit adjacent to the spindle will have a horizontal flange above which a similar flange of the gate door rail will be positioned (pancaked) and through which the nested spindle will pass, allowing the gate door rail to rotate for door opening.

Other alternative options provide single and double bi-directional doors and a double unidirectional gate door in addition to the single unidirectional gate door described above.

In another embodiment magnets are positioned at the top and bottom side section rail ends to interact with their counterparts of the gate door for closure of the gate door. Said magnets may be surface mounted or recessed, to correspond with magnets positioned in the gate door's top and bottom rail to facilitate closure of the gate door and for proper alignment of the two rail systems for the locking spindle to engage.

The locking spindle runs through the top rail, and may also run through or partially through the bottom rail. However, in order to function the locking spindle moves up and down relative to the top and bottom rails. Additionally, where optional further horizontal rails are included in the gate door, the locking spindle runs through said additional horizontal rails and must move up and down relative to said additional horizontal rails.

In yet another embodiment a gate door without side sections may be connected with multiple linked expansion sections to offer a free-standing rectangular or polygonal containment area or enclosure. Expansion sections may utilize spindles or hinges to connect adjacent sections at various angles of positioning.

Gate Body—Adjustable Gate Door

An adjustable gate door allows passage through the Gate Body when positioned in a doorway, regardless of the presence of a physical door, or as a stand-alone enclosure. The gate door is attached to the side section on the non-opening side of the gate door via hinges positioned at the junctions of the respective top and bottom horizontal rails. The upper and lower horizontal rails of the gate door and side section at the opening side of the gate door are connected via a locking mechanism, such as a locking spindle with handle as described above, and is described in more detail in a later section.

Alternatively to the use of hinges, as mentioned previously, is the utilization of a nested spindle around which the upper and lower gate door rails rotate at the non-opening side.

Another optional feature is a protective pivoting cover that can serve as a redundant locking mechanism.

One advantage of the instant invention is that there is no need for a horizontal piece to run across the floor or surface below the opening of the gate door, thereby avoiding a tripping hazard at floor level when the gate door is opened. This innovation is made possible by the secure functioning of the side arms. The top and bottom rails of the gate door only serve to hold the door's spindles in place and as a horizontal brace when the gate door is closed.

The gate door also includes nested vertical spindles, which have similar construction as described in the preceding section on side sections. A minimum vertical overlap of all upper and lower nested spindles should be of sufficient length, for example two inches as a minimum, to keep the spindles from unexpectedly separating if fallen against or pulled or pushed by a child or pet.

In an alternate embodiment the gate door may include match-boxed sections of the top and bottom rails, as described for other modular sections, in order to allow for horizontal adjustment of the gate door.

In addition to the capability of vertical height adjustment, the proposed gate door can be adjusted horizontally to offer more width to the gate door as well as the overall Gate Body. This is accomplished via match boxed top and bottom rails.

In the preferred embodiment magnets are positioned at the top and bottom of the gate door at the upper and lower rails on the opening end of the gate door. The magnets interact with mated magnets located in corresponding top and bottom rails of the side sections. Said magnets may be surface mounted or recessed, to correspond with magnets positioned in the side section's top and bottom rail. Said magnets facilitate closure of the gate door and for proper alignment of the two rail systems for the locking spindle to engage.

Gate Body—Expansion Section(s)

Individual units of the Gate Body include modular sections designed to allow units to be connected or disconnected, thereby allowing the user to add or removed individual units from the Gate Body on either side of the gate. These individual units are referred to herein as "expansion sections." The expansion section units allow the user to create a Gate Body of any width, so as to block any size door, hall, room, or other space.

To provide for the need of various widths expansion sections, comprised of similar components as described above for the side sections and gate door, including the capability for horizontal and vertical adjustment, and with the same spindle spacing as the aforementioned, can be connected between the non-opening side of the gate door and the adjacent non-opening side section for a single gate door. For a two-door gate, expansion sections may be inserted between one or both sides of the gate doors at their non-opening junctions with the adjacent side sections. An expansion section, constructed similarly to the side sections and gate door, contains at least one vertical nested frame with a foot underneath any and all frames' bases. Nested frames may utilize spring loaded devices, such as spring plungers, or other fasteners for height adjustment. Expansion sections do not include side arms. More than one expansion section may be connected between a gate door and a side section as needed. A gate door with side sections can be linked with as many expansion sections necessary to provide a very wide gate with varying angles as desired.

In alternate embodiments the expansion sections may connect with each other or with other components, either in line, at a 45 degree angle, or at a 90 degree angle. This feature allows the user to set up a Gate Body with turns or corners, and allows for set up of a free-standing enclosure of various shapes.

In alternate embodiments, straight or angled protective pivoting covers, whether fixed or hinged, may be used to maintain the configuration of the Gate Body as needed.

Another aspect of the present invention is nested sections of top and bottom rails that are capable of telescoping, thereby allowing individual sections of the gate to expand and contract along the horizontal axis. For the purposes of this specification these nested top and bottom rails will be termed "match-boxed," in order to distinguish them from the nested vertical spindles, discussed above. The match-boxed top and bottom rails allow for proper horizontal fit within a doorway in a variety of small to larger measured increments. The match boxed top and bottom rails expand and contract as a unit to horizontally adjust the size of the Gate Body assembly to fit within a doorway. In alternate embodiments the match-boxed top and bottom rails include a means to lock the movement within the match boxed top and bottom rail once the desired horizontal length is achieved. Said means to lock include spring loaded buttons within the inner section of the match boxed rails and regularly spaced holes in the outer section of the match boxed rails. Said buttons are designed to pop outward into the holes as the button slides across the holes. Such buttons can be pushed back in to allow further adjustment of the rails. Alternatively, said means includes removable protective locking covers that wrap portions of the rails, thereby locking them into place. Other means to lock movement of said rails may be used.

The nested vertical spindles also move as a unit to vertically adjust the height of the Gate Body. Between the nested spindles allowing vertical expansion and contraction, and the match boxed top and bottom rail, the instant invention expands and contracts in both the vertical and the horizontal, thereby allowing the user to adjust the Gate Body to fit any desired space.

In alternate embodiments the nested vertical spindles are replaced by solid panels that are match-boxed in either horizontal or vertical configurations, allowing said panels to adjust either vertically or horizontally. Said panels may include guides/safety guards on either side of said panels.

Another aspect of the present invention is to secure the Gate Body assembly within a doorframe or doorway, in a non-marring manner and without defacing the doorframes or walls, at various angles and via adjustable means to tighten side arms around or against the doorframe or doorway.

Side Arms—

The side arms are the means by which the Gate Body is secured to the doorway walls or an optional wall extension. Side arms are attached to doorway walls on either side of the Gate Body. The Gate Body is stabilized in the doorway by attachment to the side arms to opposing sides of the doorway. The side arms each include a means to allow the side arm portions of the side sections to move ninety degrees with respect to the rest of the side sections, allowing the user to attach the side sections to a wall.

In the preferred embodiment the side sections each include a top side arm and a bottom side arm, by which the side sections are attached to the door frame, wall extensions, stairwell balusters, walls, or similar projections. The side arms are constructed of wood, metal, hard plastics including Lucite, composites, thermoset and thermoplastic resins, acetal, polycarbonate, fiberglass, carbon fiber, etc., or combinations of these and in various designs, geometrics and dimensions. Types of side arms are interchangeable to provide a more custom fit or improved esthetics for particular needs.

In one embodiment the adjustable side sections each include a top side arm and a bottom side arm, one at each corner of the total Gate Body.

Various configurations of side arms are available, including U-shaped side arms that extend outward from the corners of the side sections and are parallel to the floor or surface below when in a closed position. Others configurations may be offset to one side of the Gate Body's plane to accommodate the presence of a physical door attached to the doorframe or some other obstacle. Still other configurations can utilize different shapes of the side arm's "tines" with respect to its "wrist," such as curved or circular rather that straight. Also, a ball and joint type of side arm with "tines" can be utilized to offer more angles of attachment. The "tines" of any side arm can be solid or hollow tubes or flat narrow extensions, or may be flag-shaped in different orientations to better fit the wall or doorway. Regardless of side arm configuration, interior surfaces of the "tines" may be covered with non-marring material or they may be encased in non-marring sleeves to protect walls and offer additional grip. Side arms pivot from their parallel position to a maximum of just over 90-degrees to release from their grip of the doorway. Use of a protective pivoting cover will occlude this channel to protect a child's inquisitive fingers and to serve as a redundant locking mechanism.

To position and secure the Gate Body, the side arms are rotated in an upward vertical stance at their pivoting "wrist," the Gate Body is placed within the doorway or desired location, then the side arms are opened and pivoted downward to position around the doorframe or baluster. For doorways or stairs, the tines of the side arms are slowly closed to secure around the doorframe or baluster, which can be facilitated by different means, such as: an extension spring, possibly within a protective casing; a compression spring; rigid side arms that can be flexed; or a hook mechanism.

In an alternative embodiment the side arms include a means to extend the side arms vertically without pivoting on a hinge. In one example the side arm includes a nested ball-bearing slide in place of the hinge for extending said side arms. In another example, the side arms include a nested section in place of the hinge with spaced spring-loaded set pins.

Non-marring linings are attached to the side arms' interiors or as sleeves to completely encase the side arms' tines to prevent damage to the doorframe or baluster.

In an alternative embodiment the side arms may be adjusted to tighten around a doorway or doorframe using strong cords that are permanently fastened to the back interior surfaces of the extended members or tines of the side arms. In one embodiment a cylinder is located in lieu of a bolt at the "wrist" of the side arm, around which the side arm pivots. Within said cylinder a gear mechanism with pins and a back piece with pins oppose each other on nested shafts, one of which is permanently attached to a knob positioned on the outside of the cylinder and on one side of the side section's topmost portion of its frame. The knob has one or more rectangular or polygonal shaped flanges extending outward from its center that fit inside similar geometric depressions within the topmost side portion of the side section's vertical frame for locking. The cords are permanently attached to the outer shaft on the interior of the cylinder, such that when the knob is pulled outward slightly and turned either clockwise or counterclockwise, depending on which side the knob is placed, the cords are wound around the back pins affixed to the back piece that opposes the knob. The cords are pulled through a hole in the anterior end of the "wrist" and then through a corresponding hole in the cylinder when the side arm is pivoted downward and parallel to the floor. As the cords are wound, the side arm's tines are pulled closer together around the doorway or doorframe until desired tightening is achieved. A permanent outside cap is positioned on the cylinder's opposite end to the knob and is attached to the cylinder's inner shaft to support and stabilize the gear mechanism and to assist in securing the cylinder to the side section's vertical frame. The knob is locked into place via the flanges to prevent the cords from unwinding and loosening the grip of the side arms.

In an alternative embodiment one of the nested shafts is stationary and the other rotates to wind the flexible cord, thereby pulling the side arm tines tight around the doorway or door frame.

Another alternative embodiment utilizes a similar pull knob with flanges whereby the knob is simply turned in a clockwise fashion until the side arms are positioned by the pull cords to the desired tightness, then the knob is locked into place.

Yet another alternative embodiment utilizes a screwdriver or ratchet wrench to turn the rotating shaft, which in turn winds the cords, thereby tightening the side arms as desired.

Another embodiment utilizes side arms attached at the top corner with pedestals attached at the bottom corners of the side sections that are too close to a wall at floor level for the utilization of side arms. A description of feet and pedestals is presented below. The upper corners of the Gate Body can still possess the previously described side arms to secure to the wall at the top.

Still another version can utilize a movable "ball and joint" mechanism, serving as a second "wrist" for a side arm that can pivot and rotate in various directions. The "ball and joint" side arm can also utilize spring loaded devices, such as spring plungers, or other fasteners to lock the two members together so they cannot be easily separated by a child or pet, as well as to lock the angle of the side arm in a fixed position.

In an alternate embodiment the tines of the side arms are replaced with suction cups designed to create vacuum between the wall and the side section of the Gate Body. This allows for attachment of the side section to flat wall surfaces where a section of wall or doorway is not available for clamping between the forks of the side arms.

Yet another version offers offset side arms to allow gate placement in a slightly forward location in respect to the center of the doorway, so a hinged door will not prevent use of the Gate Body.

To utilize the gate in stairway applications, "U"-shaped or modified "V"-shaped side arms may be positioned around staircase vertical posts or balusters. Alternatively, a circular side arm, with a juncture of two opposing ends at its outmost point and with an opened joint with an attached compression spring positioned at its "wrist," may be attached to the side section. As both sides of this spring "wrist" are pressed inward, the juncture at the opposite outer side of the circular arm is opened so the side arm can be pivoted down and around the staircase post or baluster. As with the other previously described side arms, the circular arm is lined with a non-marring material or sleeves to protect the stairway post or baluster. A protective pivoting cover, as described in a previous section, can also be utilized with any side arm to lock and prevent it from being inadvertently lifted upward to breach the gate. Other locking mechanisms can also be utilized at the outward ends of the "U"-shaped and modified "V"-shaped side arms, such as a rod bolted through the ends of the side arm's tines or bolts in the outward point of the circular side arms or "wrists," to serve as redundant locking mechanisms.

Still another option for stairways that have only flat walls at one or both sides of the top landing is a modular side arm that possesses a hook or prong that may be pivoted downward into a receiving member that is fastened to the wall. Once the hook or prong has been properly positioned within its receptor on the wall, a locking mechanism, such as a bolt or pin, may be engaged to prevent the hook from being lifted from its position, thereby securing the Gate Body. A slide bolt latch may be utilized, as well as other appropriate fasteners.

To prevent a child or pet from lifting the side arms upward to their vertical positons, allowing the gate to be compromised, a three-sided pivoting cover, with holes corresponding to spring plungers or similar fasteners in the end of the side section's frame, can be pivoted into place to deter lifting of the side arm. Another embodiment uses a tightly fitting three-sided cover, made of a slightly flexible thermoplastic elastomers, such as silicone or urethane, or other suitable material, that is fitted over the junction of the side arm's "wrist" and frame and/or top rail to deter lifting of the side arm. Other embodiments use hook and loop fasteners or cords, wires or straps with pins or hooks to secure the side arms in their closed position.

Since the proposed gate is modular with interchangeable units, any combination of side arms and pedestals can be used to safely position the gate within a doorway, stairway, or other locations, including a free-standing enclosure.

The instant invention includes at least three alternative ends on each of its top and bottom rails for interconnection of said modular parts. In one embodiment the gate door's top and bottom rails are thinner horizontally at their opening end or junction with the adjoining side section or expansion section as compared to the remainder of the gate door's rails and are aligned by horizontally overlapping or "pancaking" with the corresponding thinner ends of the side section's or expansion section's rails. Within the top center of the gate door's rail nearest the end that opens and overlaps the side section's rail, a depression is provided, and within this depression is a hole through the entire depth of the gate door's top rail and side section's rail immediately underneath. A corresponding hole is directly located in-line below in the door's bottom rail and into, but not completely through, the side section's bottom rail, which can be horizontally overlapped or "pancaked" to accommodate a unidirectional or bi-directional door.

Alternatively the top and bottom rail ends may be vertically aligned or "handshaking" to accommodate a unidirectional door only. For handshaking connections a vertical cutout is located on the opening side at the end of the side section's rail, which meets its inverse vertical cutout on the corresponding rail of the gate door's top rail. This feature will allow the locking spindle to be swung out when lifted in conjunction with a unidirectional gate door to allow passage through the gate.

Additionally, extension sections may be used that include both a handshake coupling on one side, and a pancake coupling on the opposing side. This configuration allows for conversion between one type of coupling system to another. Each type of coupling system has advantages over the others under particular circumstances. For example, one may use a handshake coupling for unidirectional gate doors, while pancake coupling allows for bi-directional gate door opening.

In the side section's and gate door's top rails a hole is located in each section, but not all the way through the rail, to sufficiently allow the bottom uneven points of a downward-pointed T- or 7-handle to be lowered within. This handle may be of single construction with the locking spindle or it can be screwed or otherwise connected onto the top of a threaded spindle. When fully lowered, this handle is flush with or only slightly raised above the top surfaces of both rails. The upper vertical spindle portion of the handle passes downward through a hole within the rail and inserts within the corresponding lower spindle attached to the gate door's bottom rail. Alternatively, the upper spindle portions may fit over and encase the lower spindle portions. This locking spindle can be made of similar materials as used for the other gate components. The lower spindle is not permanently attached to the bottom rail, as is the case with the other lower spindles, to allow lifting from its seat to open the gate. This is enabled by the lower spindle being attached by spring loaded devices, such as spring plungers, or other fasteners to the upper spindle, which is attached to the handle. The seat within the lower rail for the lower spindle is comprised of thin overlapped or pancaked layers of the bottom gate door and side section frames. The lower gate rail includes a hole to accommodate the diameter of the lower spindle. A larger hole is partially through the corresponding side section's bottom rail, beneath and plumb or in-line with the center of the hole in the gate door's rail. At the lower end of the locking spindle, a thin flat disc, made from similar materials as the other gate components, is centrally attached perpendicular to the spindle, and this disc is seated within the larger hole in the side section's top surface of the rail. However, this same disc will be unable to pass through the overhead hole within the gate door's lower rail and will, therefore, restrict the upper movement of the locking spindle but will travel with the locking spindle as the gate door is swung open. There should be sufficient space between the two overlapped or "pancaked" bottom rails, or a recessed area in the underside of the gate rail, for the disc to hover against the bottom surface of the bottom gate door's rail while the gate door is being opened.

Compression springs may be included and configured to bias the locking spindle downward. This leaves downward tension on the locking spindle that is negated when the gate handle is pulled up.

Domed washers, or similar hardware components, may be utilized inside the larger of the spindle portions to stabilize the smaller spindle portions within.

In an alternative embodiment, a horizontal rail may be included just below the top rail, and/or just above the bottom rail, of all components to further stabilize the Gate Body. Locking spindles must be free to move up and down through said additional horizontal rails. Also, rotating spindles must be free to rotate through said additional horizontal rails.

As an alternative to the above disc restrictor, small metal springs underneath and on one or both sides of the T- or 7-handle can be attached to the handle and gate door's top rail below the handle, but not the side section's rail. The springs restrict the vertical lift of the handle, but allow sufficient lift to clear the bottom of the lifting spindle from the bottom side section rail's hole and allow the opening of the gate door.

Alternatively, other shapes of handles, such as an inverted L-handle, among others, may be utilized in place of the T- or 7-handle with proper inclusion of receptor holes or canals for securing the handle and to guard against opening by a child or pet. Additionally, small knobs or rings may be used as handles. Additionally, a protective pivoting cover may be included for a redundant locking mechanism.

To open the gate door, the lifting spindle is pulled upward by lifting the handle to clear the side section's bottom rail and swinging the gate door in one or both directions. To prevent accidental lifting of the handle by a child or pet, a 3-sided protective pivoting cover is attached to the gate door's top rail behind the handle and is pivoted downward over the handle, being locked into place over the rail when pressed down by use of a spring loaded device, such as a spring plunger, or other fastener located on the side section's rail. This spring plunger or fastener must be released in order to access the handle to open the gate door, thereby acting as a redundant lock for the gate door. This protective pivoting cover may be made of similar or contrasting materials as with the other gate components.

In another embodiment the upper frames of the Gate Body and side section are squared and in the same plane to one another, almost butting against each other but leaving sufficient space for the gate door to swing open. In this embodiment the bottom rails are still horizontally overlapping ("handshake" configuration) or in vertical alignment ("pancake" configuration) to one another. In this embodiment magnets may be vertically recessed within the ends of each opposing top rail and in proper alignment within the junction of the bottom rails. The locking spindle passes through a vertical hole within the end of the gate door's full-sized upper rail. The handle atop the locking spindle is positioned such as to allow it to join the gate door and side section rails when lowered into the receptor holes within the top surface of both rails as previously described.

Yet another embodiment utilizes either an inverted "L" handle, "7" handle or a "flat T" handle without prongs instead of the previously described locking handles with uneven downward prongs. The rails for both the gate and side sections are as described above, with the exception that a horizontal canal(s) or trench(es) is present in the top end of the gate door's and side section's rails to receive the horizontal portion of the handle. A finger depression is provided around the canal or trench to allow an adult to grasp the handle for lifting and lowering the locking spindle to open and close the gate door.

Still another embodiment of the handle utilizes a winged knob, shaped similarly to a metal wing nut fastener that is attached to the upper locking spindle. Canals or trenches within the interacting ends of the adjacent rails are positioned to allow the wings to lock the gate door closed when lowered into their trenched position.

Yet another embodiment employs a vertical spindle that is attached to the top handle, whether a "T", "7", inverted "L", small knob or ring or other means, and is capable of screwing into and out of the bottom rail that is fitted with a threaded receptor for the threaded end of the lower spindle. With just a few turns and lifting of the handle, the gate may be securely opened or closed. This embodiment also may employ a short but larger diameter spindle guard at the bottom rail to avoid lifting the spindle completely out of alignment with the bottom gate door's rail.

Another embodiment utilizes a pushbutton mechanism wherein a pushbutton is attached to one end of a rod or tube or other piece that is attached to the top of a compression spring. The other end of the rod or tube or other piece is attached either directly or indirectly to the handle of the locking spindle or directly to the locking spindle when a handle is not used. This configuration exerts a levering effect when the pushbutton is pushed downward, effectively causing the rod, etc. to pull the handle and/or locking spindle upward to allow the gate door to be swung open. This pushbutton mechanism can be elevated above the top rail, within the same plane as the top surface of the top rail or recessed within the interior of the top rail. When said push button mechanism is elevated above or level with the top rail the button mechanism and locking spindle mechanism resides within a protective encasement to prevent a child or pet from pushing the button to open the gate door. The protective encasement is attached to the gate door's top rail and not the side sections' rail, though it slightly hovers over the latter to allow the gate door to be swung open. A protective pivoting cover may be utilized to protect the integrity of the locking mechanism.

Magnets may be surface-mounted or recessed into the rails' surfaces on the inside horizontal or vertical surfaces of the overlapping rails, both top and bottom. Said magnets aid in closing the gate door and for proper alignment of the gate's door with the various redundant locking systems. Protective pivoting covers with spring loaded devices, such as spring plungers, or other fasteners, locking pins with or without tethers, hook and loop fasteners, hooks, or cords or chains may also be utilized.

Feet—

Positioned on the underneath corners of the side section's and expansion section's vertical frames are short feet, already mentioned within the former sections, to hold the gate assembly off the floor, to offer grip to the floor's surface, to help stabilize the Gate Body, to help prevent damage to the floor if a child or pet bumps into the gate and to prevent scraping of the floor when the gate door is opened. The feet may be constructed of materials including but not limited to metal, wood, hard plastics including Lucite, acrylics, carbon fibers, fiberglass, polycarbonate, acetal plastics, composites, thermoplastic and thermoset resins, or other materials, and combinations of materials which prevent scratching the floor surface. The feet only minimally raise the bottom horizontal rails off the floor to prevent items from being rolled underneath the Gate Body, which could cause frustration to a child or pet.

Where the bottom of walls or baseboards do not accommodate side arms, straight pedestals or even adjustable angles, such as 45-degree and 90-degree angles, fixed or hinged, may be attached via the bottom side arm port in a perpendicular fashion to the plane of the gate to accommodate similarly angled walls or baseboards. Pedestal bottoms may be lined with non-marring materials, such as silicone, urethane and other thermoplastic elastomers or materials such as felt, to prevent damage to the surface underneath.

It is to be understood that both the foregoing general description and the following detailed description provide embodiments of the invention and are intended to provide an overview or framework of understanding the nature and character of the invention as it is claimed. Other aspects of this invention will appear from the following detailed description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION

The present invention, which is described more fully hereinafter, provides a child/pet gate assembly comprised of modular and interchangeable components with non-marring surfaces and offering incremental horizontal adjustability to properly occlude and securely fit within a defined doorway or space and offering incremental vertical adjustability to suit varying height needs, without requiring permanent attachment to a doorframe or walls. This invention may be embodied in many different forms and should not be construed as limited to the specific embodiments described herein.

Referring to FIGS. 1-14 in the preferred embodiment of the gate the following are the primary components: two side sections; two top side arms; two bottom side arms; a gate door; expansion section(s); and feet. Alternate embodiments are also described.

Gate Body

Figure 1:
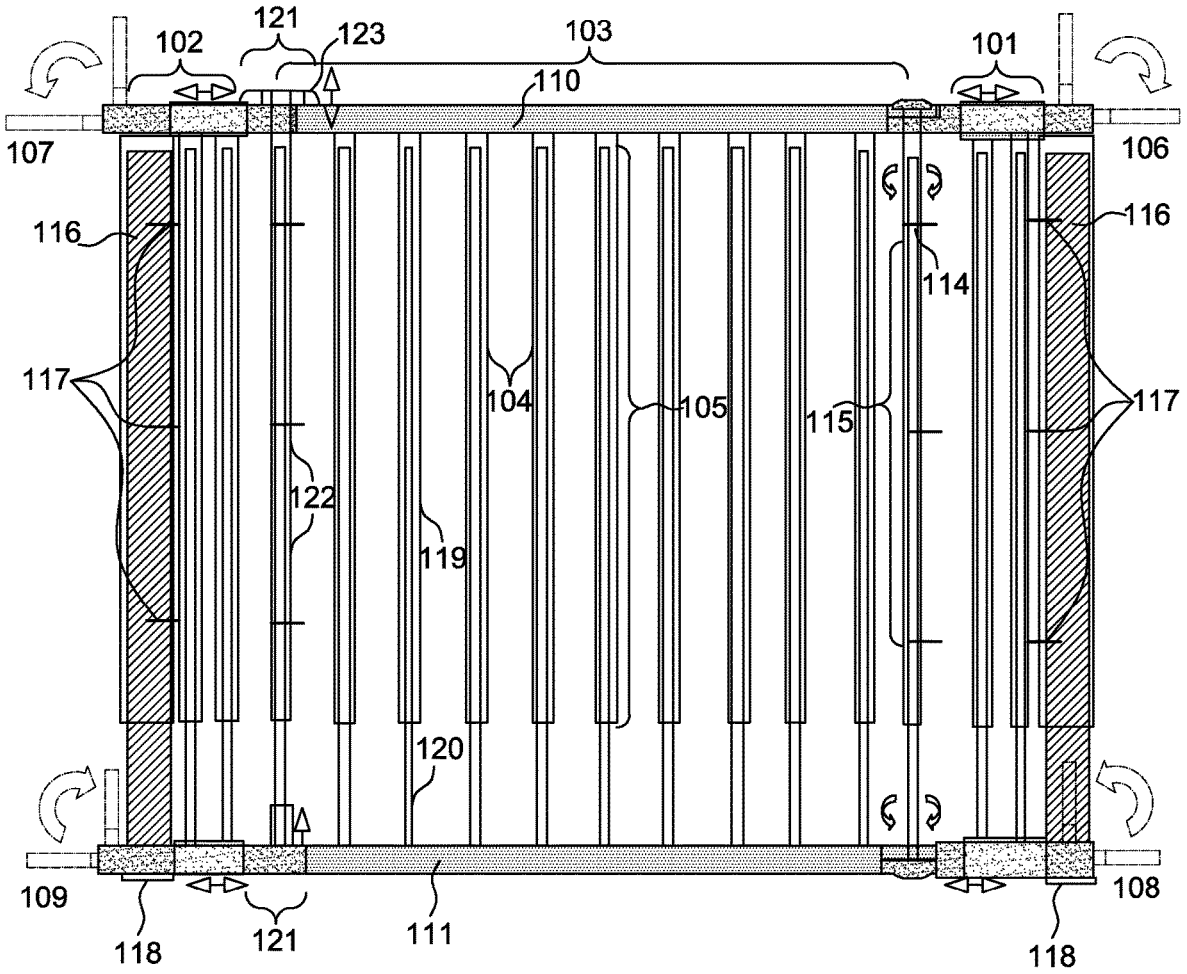
FIG. 1 is a side view of the disclosed gate.

Referring to FIG. 1, two adjustable side sections [101][102] and one or two swinging gate doors [103], comprise the basic Gate Body, which is adjustable both horizontally and vertically, as well as any optional expansion sections to complete the Gate Body. Each of these components contain nested spindles or vertically-linked spindles, which are described in later sections. For nested spindles [104], a minimum vertical overlap [105] of the nested spindles [104] should be of sufficient length, for example two inches as a minimum, to keep the spindles [104] from unexpectedly separating if fallen against or pulled/pushed by a child or pet. For vertically-linked spindles [104], all open ends of the two or more spindle members can be threaded to accept swivel connectors to join the sequence of spindles [104] to one another. All of these components can be constructed in varying widths and heights, of various geometric designs and materials, and with varying spacing between vertical members, with a suggested minimum of two inches, to accommodate desired needs and esthetics.

There are two adjustable side sections [101][102] immediately positioned one on each side of the adjustable gate door [103], unless expansion units are utilized. These adjustable side sections [101][102] contain side arms [106][107][108][109], one at each of the four corners of the Gate Body or, alternatively, two at the top corners [106][107] with two elongated pedestals [1301] at the bottom of the side sections [101][102]. Non-opening ends of upper [110] and lower [111] horizontal rails [110][111] of the gate door [103] are coupled with corresponding horizontal side [101][102] section rails [112][113].

In the preferred embodiment a rotatable nested spindle [114] is attached to the upper [112] and lower [113] rails [112][113]. Said rotatable spindle [114] includes spring loaded devices, such as spring plungers [115], to allow for predetermined vertical adjustments. The rotatable spindle [114] is attached to the upper [112] and lower [113] rails [112][113] to secure in place, but allow the gate door [103] to easily rotate around the rotatable nested spindle [114] for opening.

Figure 2:
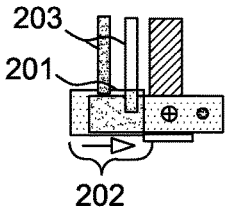
FIG. 2 is a side view of a match-boxed bottom rail.
Figure 3:
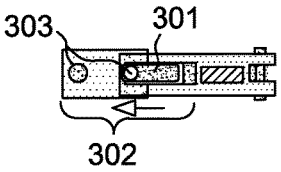
FIG. 3 is a top view of a match-boxed bottom rail.

Referring to FIG. 2, which is a side view of an exemplary bottom match-boxed side section rail [113], and FIG. 3, which is a top view of the same match-boxed side section rail [113], the upper [112] and lower [113] rails of the side sections [101][102] are match-boxed (alternatively referred to as "horizontally-nested sliding units") to allow horizontal adjustment of the side sections [101][102]. In the preferred embodiment the side section's nested outer vertical frame [116] includes spring loaded devices, such as spring plungers [117] to keep the entire side section [101] at its user-adjusted height while accommodating vertical movement when temporarily disengaged.

A short foot [118] is attached to the underside of the side sections' [101][102] outer vertical frames [116] to provide sufficient space for the gate door [103] to swing open without scraping the floor or surface below.

The outer corners of the side sections' [101][102] horizontal rails [112][113] are constructed to permit attachment of modular interchangeable side arms [106][107][108][109].

The spindles [104] are comprised of upper [119] and lower [120] nested members [119][120], to facilitate vertical adjustment of the side sections [101][102]. A minimum vertical overlap [105] of all upper [119] and lower [120] spindles [104] and vertical frames [116] is of sufficient length to offer strength and to keep the spindles and frames from unexpectedly separating if contacted or pulled or pushed by a child or pet.

Upper [119] and lower [120] spindles portions [119][120] are integrated with their respective match-boxed upper rail [112] and match-boxed lower rail [113]. Referring to FIGS. 2 and 3, the match-box units have a slot [201][301] to allow a spindle [203][303] to freely move inside said slot [201][301]. Each match-boxed rail [112][113][202][302] has a nested spindle [203][303] attached to the match-boxed rail [112][113][202][302]. When each match-boxed rail [112][113][202][302] is extended or retracted, its affiliated spindle [203][303] extends or retracts in the horizontal direction within the slot [201][301]. This configuration is repeated with each of the spindles [114] along the length of a single match-boxed upper [112] and lower [113] rail [112][113]. These match-box rails [112][113] allow horizontal adjustment of their associated spindles [104] to provide better fit of the overall Gate Body within a doorway or restricted space and can be locked in place via various locking mechanisms.

Figure 4:
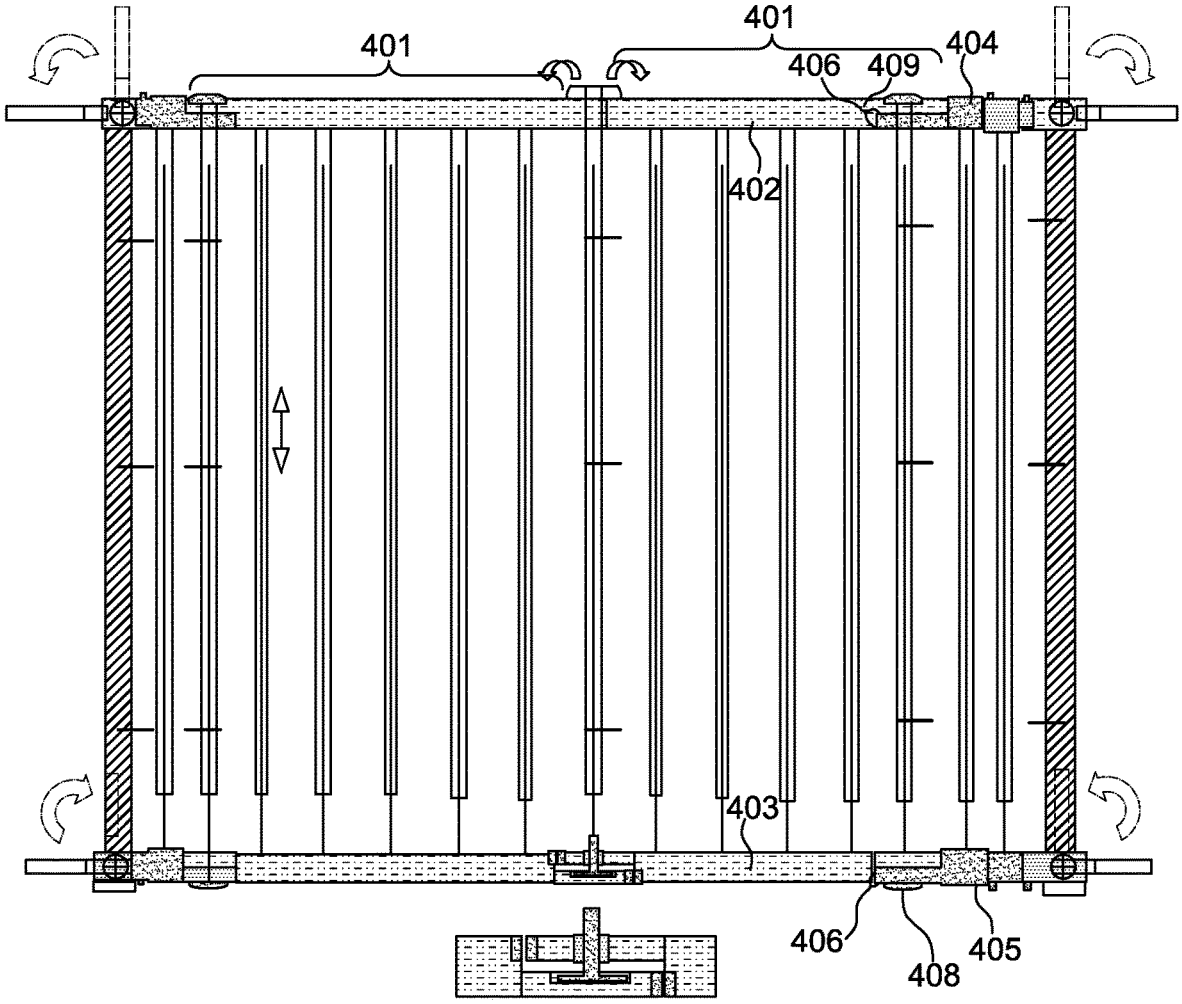
FIG. 4 is a side view of the gate with optional double doors.
Figure 5:
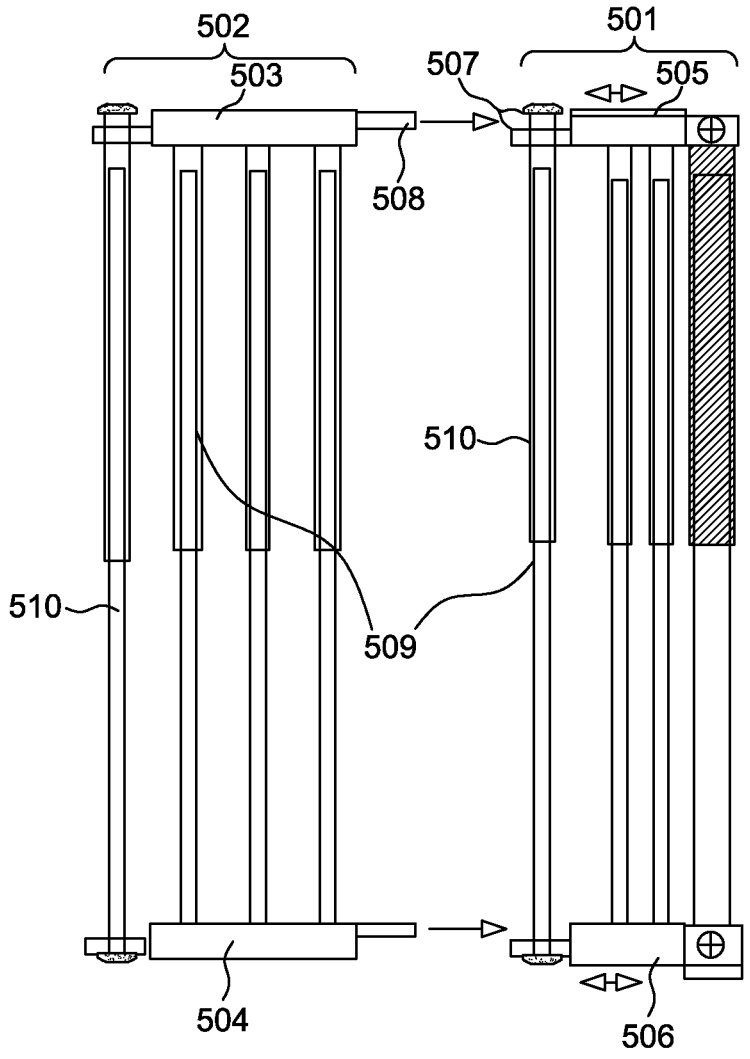
FIG. 5 is a side view of the extension sections.

Referring to FIG. 4, which is a side view of a Gate Body with double gate doors [401], and to FIG. 5, which is a side view of a side section [501] and an extension section [502], top [401][503] and bottom [403][504] horizontal rails [402][403][503][504] on all modular components include a means to couple with corresponding top [402][503] and bottom [403][504] rails of neighboring components [404][405][505][506]. In one embodiment the means to couple the components includes a portion of the top [404][505] and bottom [405][506] rails at the coupling end of said rails [404][405][505][506] that have reduced depth [406][507] compared to the remainder of the rails [404][405][505][506]. Corresponding portions [409][508] of rails [402][403][503][504] on the neighboring component [401][502] are shaped to fill in the "missing" portion [409][507] of the corresponding rail [402][403][505][506] of the coupled component [401][501]. For example, coupled portions of a given rail [402] may be designed to allow the top portion [409] of a rail [402] to extend over the corresponding portion [406] of the neighboring component where said neighboring component has been designed to have the bottom portion [406] of said rail [402] extend into the "missing" portion [409] of the other component's rail [402]. This method of coupling is referred to herein as a "pancake" coupling.

Figure 6:
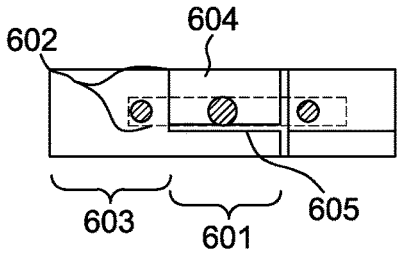
FIG. 6 is a top view of a "handshake" coupling between components.
Figure 7:
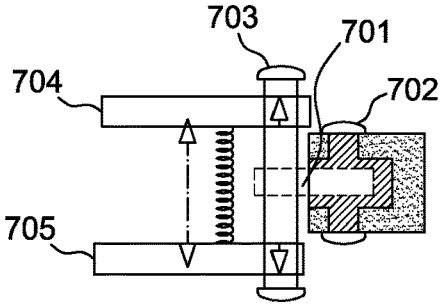
FIG. 7 is a top view of a side arm.
Figure 8:
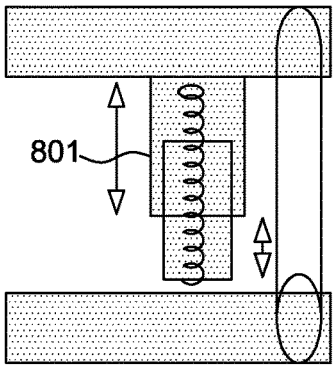
FIG. 8 is a top view of an alternate embodiment of a side arm.
Figure 9:
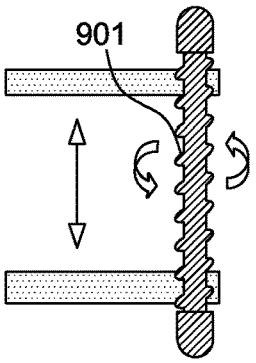
FIG. 9 is a top view of another alternate embodiment of a side arm.
Figure 10:
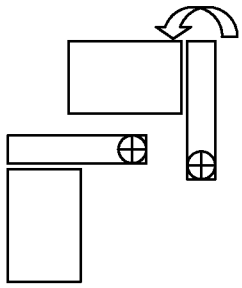
FIG. 10 is a side view of another alternate embodiment of a side arm.

Alternatively, referring to FIG. 6, which is a top view of the coupling ends of a top rail, a portion of the top rail [601] at the coupling end of said rail may have reduced width [602] on one or the other side of said rail [601] compared to the remainder of the rail [603]. Corresponding portions of the rail on the neighboring component are shaped to fill in the "missing" width portion of the corresponding rail of the coupled component. Coupling portions of a given rail is achieved by placing the one side portion [602] of a rail to extend next to the corresponding portion [604] of the neighboring component where said neighboring component has been designed to have the other side of said rail extend into the "missing" portion [602] of the other component's rail. This method of coupling is referred to herein as a "handshake" coupling.

Both pancake and handshake coupling portions may include magnets [605] positioned to interact with their counterparts of the gate door. Said magnets [605] may be surface mounted or recessed, to correspond with magnets positioned in the gate door's top and bottom rail to facilitate closure of the gate door and for proper alignment of the two rail systems for the locking mechanism to engage.

Referring again to FIG. 4, any modular unit adjacent to the rotatable spindle [408] will have a pancaked coupling through which the rotatable nested spindle [408] will pass, thereby allowing the gate door [401] to rotate for door opening.

Multiple expansion sections [101][102][501][502] may be sequentially connected to achieve the desired width for the overall Gate Body assembly.

Gate Body—Adjustable Gate Door

Referring back to FIG. 1, an adjustable gate door [103] allows passage through the Gate Body when positioned in a doorway, or as a stand-alone enclosure. The gate door [103] includes nested vertical spindles [104]. The upper and lower horizontal rails [110][111] of the gate door [103] and side section [102] at the opening side of the gate door are connected via a locking mechanism[119]. In the preferred embodiment the locking mechanism [119] is a locking spindle [122] with a handle [123].

Gate Body—Expansion Section(s)

Some doorways may require a very wide gate, possibly wider than horizontal adjustments to the side sections and gate door can provide. To fulfill these needs expansion sections of various widths are connected between the gate door and the adjacent side sections. Referring to FIG. 5, an expansion section [502] is constructed similarly to the side sections [501] and contain at least one vertical nested spindles [509]. Expansion sections [502] do not include side arms. More than one expansion section [502] may be connected between a gate door [103] and a side section [101], as needed. In the preferred embodiment expansion sections utilize a removable nested spindle [510] to attach to each other or the gate door [103].

Side Arms—

In the preferred embodiment the side sections [101][102] each include a top side arm [106][107] and a bottom side arm [108][109], by which the side sections [101][102] are attached to a door frame, wall extensions, stairwell balusters, walls, or similar structures. Types of side arms [106][107][108][109] are interchangeable to provide a more custom fit or improved esthetics for particular needs.

Various configurations of side arms [106][107][108][109] are available including U-shaped side arms [106][107][108][109] that extend outward from the corners of the side sections [101][102] and are parallel to the floor or surface below when engaged with a building. Side arms [106][107][108][109] include a means to pivot the side arms 90 degrees in the plane of the Gate Body, and a means to attach said side arms [106][107][108][109] to a structural component of a building. In the preferred embodiment the side arms [106][107][108][109] include a "wrist" [701], a first connecting pin [702] that attaches the side arm [106][107][108][109] to the side section [101][102], and a second pin [703] connecting the wrist [701] to two tines [704][705]. The side arm [106][107][108][109] is pivoted via the first pin [702] so that the two tines [704][705] are on either side of a wall. The tines [704][705] are then tightened so as to squeeze the wall between the two tines[704][705], thereby securing the side arm [106][107][108][109] to the wall.

In the preferred embodiment the means to tighten the tines includes a spring [706] between the tines [704][705], biased to pull the tines [704][705] together. In an alternate embodiment the spring [706] is covered by match-boxed tubes [801]. In another alternate embodiment the tines [704][705] are pulled together via a threaded second pin [901].

Figure 11:
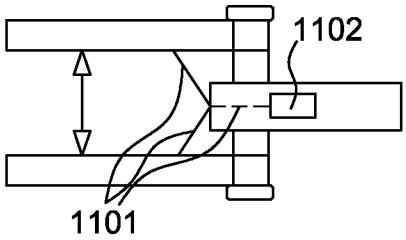
FIG. 11 is a top view of an alternate embodiment of a side arm.

Referring now to FIG. 11, which is a top view of an alternative embodiment for the side arms [106][107][108][109], includes strong cords [1101] that are permanently fastened to the back interior surfaces of the extended tines of the side arms [106][107][108][109]. The cords [1101] are attached at the other end to a cylinder [1102] located within wrist [701] of the side arm [106][107][108][109].

Figure 12:
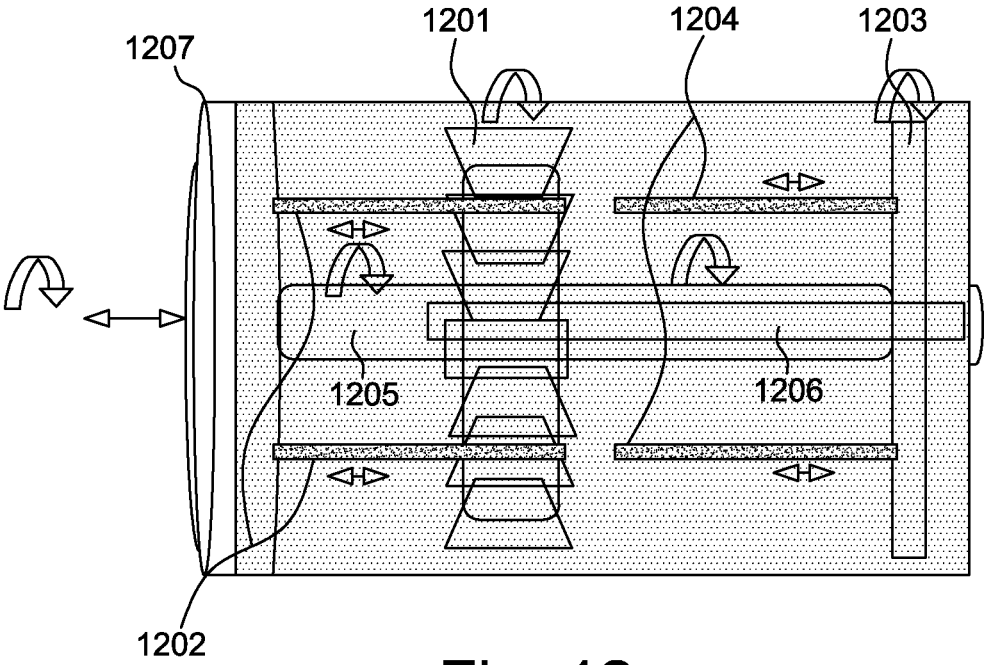
FIG. 12 is a cutaway view of the interior of a side arm wrist.

Referring to FIG. 12, which is a cutaway view of the wrist [701], reveals a gear mechanism [1201] with a first set of pins [1202] and a back piece [1203] with a second set of pins [1204] which oppose each other on nested shafts [1205][1206], one of which is permanently attached to a knob [1207] positioned on the outside of the cylinder [1102]. The cords [1101] are permanently attached to the outer shaft [1205] on the interior of the cylinder [1102], such that when the knob [1207] is pulled outward slightly and turned, the cords [1101] are wound around the second set of pins [1204] affixed to the back piece [1203] that opposes the knob [1207]. The cords [1101] are pulled through a hole in the center of the wrist [701]. As the cords [1101] are wound, the side arm's [106][107][108][109] tines [704][705] are pulled closer together around the doorway or doorframe until desired tightening is achieved. The knob [1207] is locked into place via the second set of pins [1204] engaging the gear mechanism [1201], thereby preventing the cords [1101] from unwinding and loosening the grip of the side arms [106][107][108][109].

Figure 13:
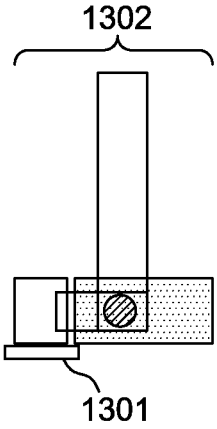
FIG. 13 is a side view of the bottom of a side section with an alternative pedestal in place of the bottom side arm.

Referring to FIG. 13, which is a side view of the bottom portion of a side section [101], in an alternate embodiment side arms [106][107][108][109] attach at the top corner as previously described, but in place of the bottom side arm [107][109] a pedestal [1301] is attached at the bottom corner of the side section [1302].

Figure 14:
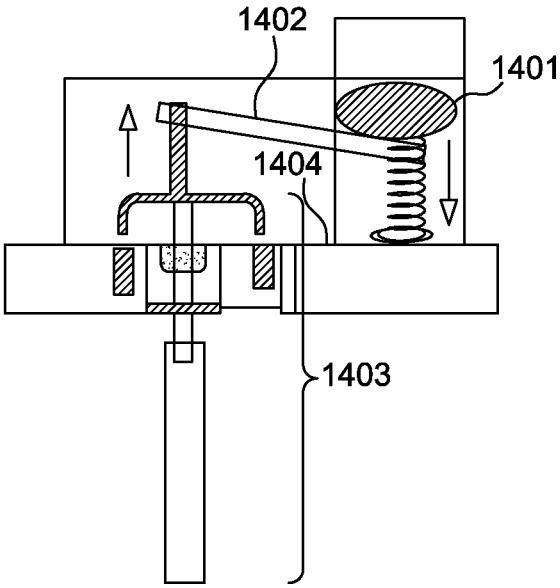
FIG. 14 is a side view cutaway of an alternate push button mechanism for unlocking the gate.

Referring to FIG. 14, which is an alternate embodiment of the locking mechanism [121], a spring biased button [1401] connects with a lever [1402], which is balanced or seated on a vertical fulcrum [1404]. When the button [1401] is depressed the lever [1402] pulls the locking mechanism [121][1403] up, thereby unlocking the gate.

Figure 15:
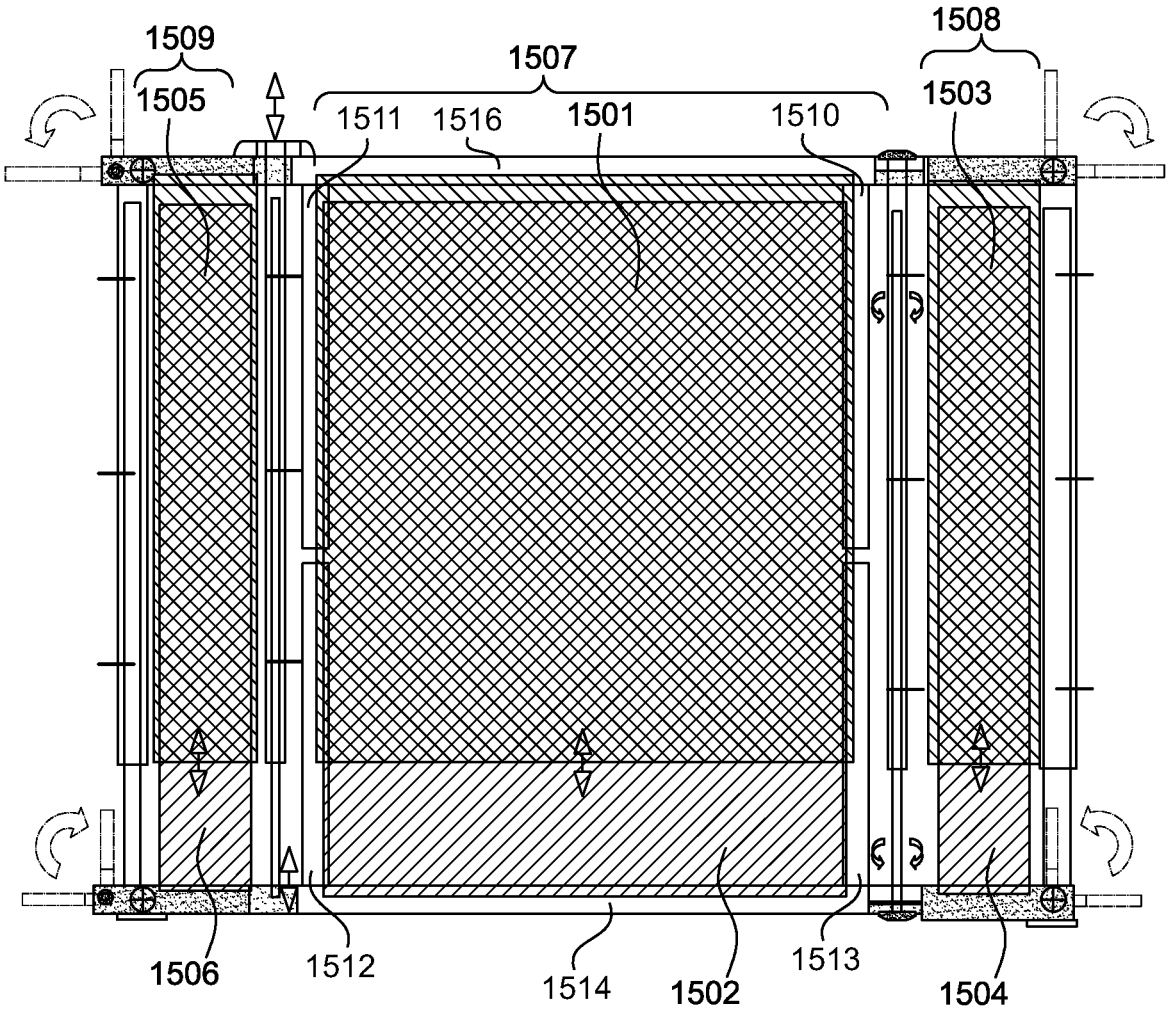
FIG. 15 is a side view of the Gate Body with alternate vertically adjustable solid panels.

Referring to FIG. 15, which is an alternate embodiment wherein solid panels [1501][1502][1503][1504][1505][1506] are used in place of nested spindles on the gate door [1507] and the side sections [1508][1509]. The top solid panels [1501][1503][1505] are arranged to slide over the bottom panels [1502][1504][1506] allowing for vertical adjustment of the gate door [1507] and side sections [1508][1509]. Vertical guides [1510][1511][1512][1513] along the sides of the panels [1501][1502] hold the panels in relation to remainder of the gate [1507], while also providing a guard to protect users from sharp edges. In this embodiment the lower vertical guides [1512][1513] are attached to the lower rail [1514] of the gate door [1507]. The upper vertical guides [1510][1511] are attached to the upper rail [1516] of the gate door [1507].

Figure 16:
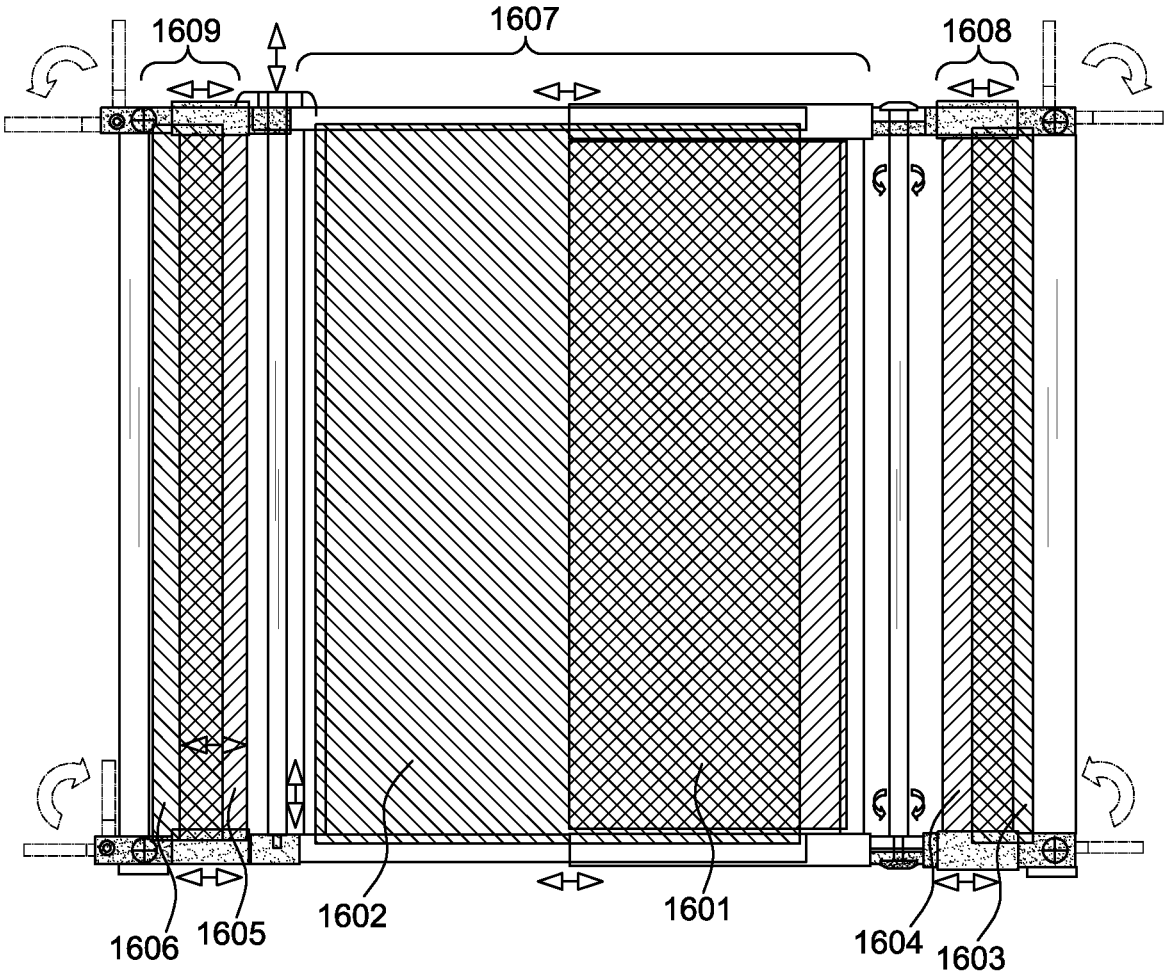
FIG. 16 is a side view of the Gate Body with alternate horizontally adjustable solid panels.

Referring to FIG. 16, which is an alternate embodiment wherein solid panels [1601][1602][1603][1604][1605][1606] are used in place of nested spindles on the gate door [1607] and the side sections [1608][1609]. For the gate door [1607], and each of the side sections [1608][1609] two panels are arranged such that one panel [1602] slides behind or in front of the other [1601]. Vertical guides [1610][1611] along the sides of the panels [1601][1602] hold the panels in relation to remainder of the gate [1607], while also providing a guard to protect users from sharp edges. In this embodiment the top and bottom rails are match-boxed to allow said rails to adjust horizontally.

It is to be understood that both the foregoing general description and the following detailed description provide embodiments of the invention and are intended to provide an overview or framework of understanding the nature and character of the invention as it is claimed. Other aspects of this invention will appear from the following detailed description and appended claims, reference being made to the accompanying drawings forming a part of this specification wherein like reference characters designate corresponding parts in the several views.

What is claimed is:

1. A modular child/pet gate that is adjustable in both the horizontal and vertical directions, comprising:

a first side section, said first side section including a first side arm, and at least one vertical nested spindle, said first side section also including at least one match-boxed top rail, and at least one match-boxed bottom rail;

a second side section, said second side section including a second side arm, and at least one vertical nested spindle, said second side section also including at least one match-boxed top rail, and at least one match-boxed bottom rail;

a gate door, said gate door including at least one vertical nested spindle, said gate door also including at least one match-boxed top rail, and at least one match-boxed bottom rail, said gate door being positioned between said first side section and said second side section;

wherein said first side section, said second side section, and said gate door are configured to increase or decrease the vertical length of said sections and gate door in a non-quantized manner by increasing or decreasing the amount of overlap between said vertical nested spindles;

wherein said first side section, said second side section, and said gate door are configured to increase or decrease the horizontal length of said sections and gate door in a non-quantized manner by increasing or decreasing the amount of overlap between said match-boxed top rails and bottom rails;

a means to swing said gate door relative to said first and second side sections;

a locking mechanism; and at least one of said side arms comprising at least two approximately parallel tines extending away from said respective side section and configured to squeeze a building structure between said tines and a means to decrease distance between said tines, thereby securely attaching said side arm to said building structure.

2. The gate of claim 1 further including at least one expansion section.

3. The gate of claim 1 wherein said means to swing said gate door relative to said first and second side sections is a rotatable nested spindle positioned between said gate door and said second side section.

4. The gate of claim 1 wherein when said gate door is open, said first side section and said gate door are not in physical contact with said second side section.

5. The gate of claim 1 wherein said first and second side arms include a ball joint rotateably connecting said first and second side arms to said first and second side sections, respectively.

6. The gate of claim 1 wherein said first and second side arms further include a non-marring material located where said side arms interact with a building structure.

7. The gate of claim 1 wherein said tines comprise flag-shaped extensions from said side arms, for attachment to a wall or other flat structure.

8. The gate of claim 1 wherein said gate door includes a magnet set in said top rail, positioned to interact with an opposing magnet set in said second side section when said gate is closed.

9. The gate of claim 1 further including at least one expansion section, wherein said expansion sections are configured to attach to either in-line, at a 45 degree angle, or at a 90 degree angle.

10. The gate of claim 1 wherein at least one of said nested spindles include at least one spring tensioned button to hold said spindles at a pre-determined length.

11. The gate of claim 1 wherein at least one of said match-boxed rails include at least one spring tensioned buttons to hold said rails at a pre-determined length.

12. The gate of claim 1 further including at least one additional horizontal rail positioned between said top rails and said bottom rails.

13. A modular child/pet gate that is adjustable in both the horizontal and vertical directions, comprising:

a first side section, said first side section including a first side arm, and at least one vertical nested spindle, said first side section also including at least one match-boxed top rail, and at least one match-boxed bottom rail;

a second side section, said second side section including a second side arm, and at least one vertical nested spindle, said second side section also including at least one match-boxed top rail, and at least one match-boxed bottom rail;

a gate door, said gate door including at least one vertical nested spindle, said gate door also including at least one match-boxed top rail, said gate door being positioned between said first side section and said second side section;

a means to swing said gate door relative to said first and second side sections; and a locking mechanism; wherein said locking mechanism is a nested spindle positioned at the side of the gate door opposite the means to swing said gate door, and wherein said nested spindle is free to move up and down relative to the remainder of the gate door and wherein a bottom portion of said spindle rests in an indentation in the bottom rail of said first side section when said nested spindle moves downward and when the gate door is closed.

14. The gate of claim 13 wherein said indentation in the bottom rail of said first side section includes a first magnet positioned to interact with a second magnet located in said bottom portion of said spindle.

15. The gate of claim 13 wherein said first and second side arms each comprise at least two opposing tines and wherein said first and second side arms include a means to secure said side arms to a building structure by decreasing distance between said tines.

16. The gate of claim 13 wherein said first and second side arms are attached to said first and second side sections via a pivot hinge configured to allow a first and second side arm tines to be pivoted such that the first and second side arm tines to be positioned on opposing sides of a wall.

17. A double-door modular child/pet gate that is adjustable in both the horizontal and vertical directions, comprising:

a first side section, said first side section including a first side arm, and at least one vertical nested spindle, said first side section also including at least one match-boxed top rail, and at least one match-boxed bottom rail;

a second side section, said second side section including a second side arm, and at least one vertical nested spindle, said second side section also including at least one match-boxed top rail, and at least one match-boxed bottom rail;

a first gate door, said first gate door including at least one vertical nested spindle, at least one top rail, and at least one bottom rail, said first gate door being swingably attached to said first side section;

a second gate door, said second gate door including at least one vertical nested spindle, at least one top rail, and at least one bottom rail, said second gate door being swingably attached to said second side section;

a means to swing said first gate door and said second gate door relative to said first and second side sections, and relative to each other;

a magnet set in said first gate door's top rail, positioned to interact with an opposing magnet set in said second gate door's top rail when said gate is closed; and a locking mechanism.

18. The gate of claim 17 wherein said locking mechanism is a nested spindle positioned where said first gate door and said second gate door meet when said gate doors are closed, and wherein said nested spindle is free to move up and down relative to the remainder of said gate doors, and wherein said nested spindle runs through said bottom rail of said first gate door, and wherein a bottom portion of said spindle rests in an indentation in the bottom rail of said second gate door when said nested spindle moves downward and when the gate doors are closed.

* * * * *